United States Patent [19]

Cook

[11] 3,962,729

[45] June 15, 1976

[54] ZIPPER FLY CONSTRUCTION FOR GARMENTS

[75] Inventor: Dudley W. Cook, Merriam, Kans.

[73] Assignee: The H. D. Lee Company, Inc., Shawnee Mission, Kans.

[22] Filed: Aug. 19, 1974

[21] Appl. No.: 498,746

Related U.S. Application Data

[63] Continuation of Ser. No. 342,473, March 19, 1973, abandoned.

[52] U.S. Cl. ..... 2/234; 24/205.1 R; 24/205.16 R; 2/265

[51] Int. Cl.[2] ..... A41D 1/06; A44B 19/34

[58] Field of Search ..... 24/205.1, 205 B; 2/236, 2/265, 96, 93, 128

[56] References Cited

UNITED STATES PATENTS

| | | | |
|---|---|---|---|
| 2,002,306 | 5/1935 | Berlin | 2/128 |
| 2,078,461 | 4/1937 | Siegel | 2/93 |
| 2,084,499 | 6/1937 | Newman | 24/205.1 R |
| 2,148,269 | 2/1939 | Koch | 2/96 |
| 2,325,332 | 7/1943 | Marinsky | 24/205.1 R |
| 2,370,059 | 2/1945 | Marinsky | 24/205.1 R |
| 3,187,346 | 6/1965 | Jacobson | 2/234 |
| 3,827,085 | 8/1974 | Ackermann | 24/205.1 R |

FOREIGN PATENTS OR APPLICATIONS

| | | | |
|---|---|---|---|
| 192,870 | 11/1957 | Austria | 2/128 |
| 834,554 | 3/1952 | Germany | 2/265 |

*Primary Examiner*—Bernard A. Gelak
*Attorney, Agent, or Firm*—Lowe, Kokjer, Kircher, Wharton & Bowman

[57] ABSTRACT

A zipper-fly arrangement for connecting two garment body panels and for concealing the zipper when closed. The panels are arranged in the form of a right hand and a left hand panel with cooperating zipper scoops to be connected with each panel. The zipper components are carried by right and left zipper tapes, each having a web with an edge to which the zipper scoops are connected and an extended portion terminating in another edge which is substantially parallel with the zipper edge, the other portion being disposed to extend past and overlie the zipper scoops. The right and left zipper tapes are positioned on the respective panels so that the zippered edges can be joined to close the panels. When the zipper is closed, the front and back faces of the zipper, i.e., the scoops, are covered by the extended portions of the web of each tape.

4 Claims, 4 Drawing Figures

ZIPPER FLY CONSTRUCTION FOR GARMENTS

RELATED APPLICATION

This application is a continuation of my earlier application Ser. No. 342,473, filed Mar. 19, 1973, now abandoned.

BACKGROUND AND SUMMARY OF THE INVENTION

For many years the garment industry has been using a fly construction in which substantially all of the fly is made either of the fabric from which the garment is made or of special fly fabrics. While zipper tapes have been used, they have been relatively narrow with the tapes performing no function other than as a medium of connecting the zipper scoops to the fly. The tapes have normally been attached to the fly assembly during initial part of construction and the fly assembly has then been coupled with the panels to complete the operation.

The construction of the fly and incorporation of it in the garment thus involved several preliminary steps, namely, first, set the zipper to one fly section and serge the opposite edge of one fly section, then set the zipper to the right fly thus to create a fly assembly. After these steps have been accomplished the fly is attached to the garment. In the prior art it took two stitches to set the zipper to the left fly plus the expense of serging the left fly. Setting the zipper to the right fly section also involved stitching.

The present invention provides a new zipper-fly arrangement wherein the aforementioned preparatory steps are eliminated. In my invention the zipper scoops are provided along one edge of a zipper tape which has an integral portion formed as an extension which cooperates with the overall fly assembly in the manner not previously encountered. The integral portion terminates in an edge remote from the zipper scoop edge and which runs substantially parallel to the zipper scoop edge. The extended portion of the web is so formed and is of such width in the direction transverse to the zipper edge that it will fold back over and cover the zipper scoops when the scoops are interlocked in the closed condition.

An important feature of the invention is that it provides a unique and inexpensive zipper fly for use in the garment industry.

Another feature of the invention is that it provides a way of conserving time in constructing a zipper fly.

Still another feature of the invention is that it provides an arrangement which makes it possible to utilize less of the garment or other special materials in constructing flies than has heretofore been the case.

Other and further objects of the invention, together with the features of novelty appurtenant thereto, will appear in the course of the following description.

DETAILED DESCRIPTION

In the accompanying drawings, which form a part of the specification and are to be read in conjunction therewith, and in which like reference numerals indicate like parts in the various views.

Figure 1:
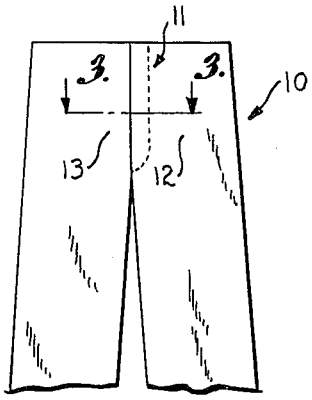
FIG. 1 is a front elevational view of a zipper fly embodying the invention and as applied to trousers, the trousers being shown with the zipper in the closed and concealed condition.
Figure 3:
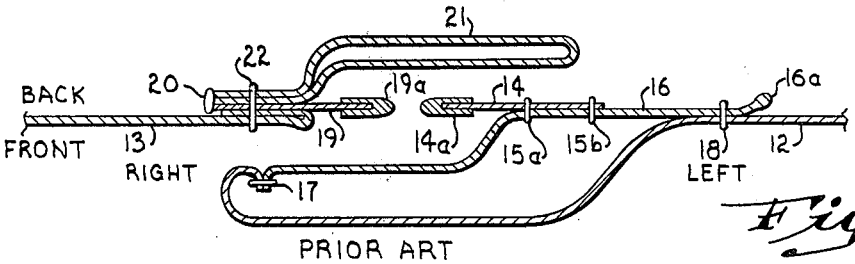
FIG. 3 is a sectional view of a typical prior art arrangement, being taken along a line like line 3—3 of FIG. 1 in the direction of the arrows.

Referring now to the drawings, and initially to FIGS. 1 and 3, a pair of trousers 10 is shown with a zipper fly construction 11, the fly interconnecting the left body panel 12 and the right body panel 13. In the typical fly construction which has preceded my invention (and as illustrated in FIG. 3) a left zipper tape 14 fitted with zipper scoops 14a is attached to the left zipper fly section 15 by two stitches 15a, 15b. The zipper is part of a relatively narrow tape having but a single ply. The attaching of the tape to the fly section 15 is normally the first step in the fly construction operation. One edge of the fly section 15 (that to be located on the inside of the garment) is serged as at 16 to prevent raveling. The serging represents a second step in the operation. Thereupon the fly section 15 is connected with the edge of the front left body panel 12 by an inturned seam stitch 17. The other edge of the fly section 15 is unattached by stitching as at 18 to the inside of the left body panel to complete the left side of the fly assembly.

To construct the right hand portion of the fly assembly, and again as viewed in FIG. 3, the second zipper tape 19 is equipped with zipper scoops 19a. The initial step in construction of the right fly and zipper subassembly is to serge the tape 19 along its non-zipper edge and as at 20 to the right fly section 21 which in this instance is a doubled over fabric. The fly zipper section with zipper intact is now stitched by stitch line 22 to the right body panel and the fly assembly is completed.

The construction of the fly assembly of the prior art and as illustrated in FIG. 3 required, in addition to the body panel, four separate pieces of material (fly sections 16 and 21 and zipper tapes 14 and 19), five stitch lines (lines 15a, 15b, 18, 17 and 22) and two serge stitches (16a and 20).

Figure 2:
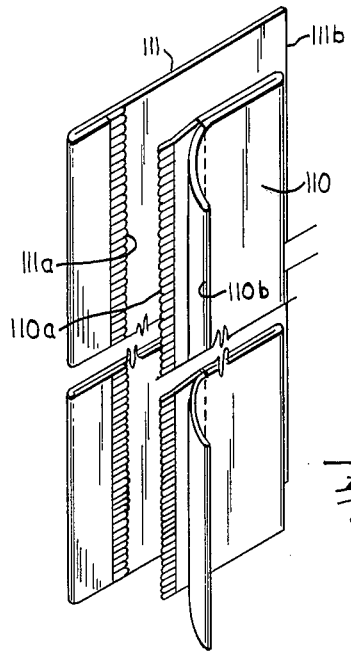
FIG. 2 is a perspective view of the zipper tape components of the preferred embodiment of the invention, but without being connected to a garment.
Figure 4:
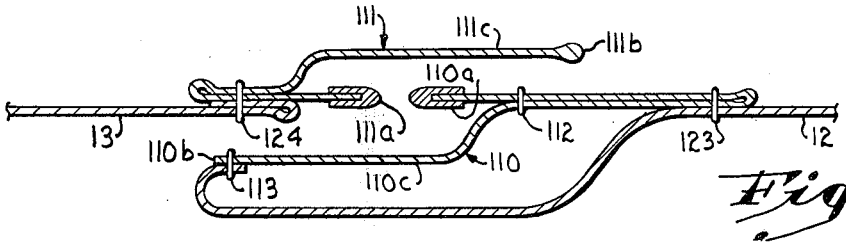
FIG. 4 is a sectional view similar to FIG. 3 but actually taken along lines 3—3 of FIG. 1 in the direction of the arrows and showing the preferred embodiment of the present invention.

Turning now to FIG. 4 and a description of the preferred embodiment, with reference also to FIG. 2, as in the prior art the basic garment includes a left panel 12 and a right panel 13. However, the entire fly construction is made up of two folded zipper tapes 110 and 111, each of which is equipped along one edge with zipper scoops **110*a*, 111*a* respectively. The fabric of which the zipper tapes is composed is of any conventional tape-type fabric, although obviously various styles and grade of fabric may be used. As compared with the width of the conventional tapes as in the prior art, the latter is usually no more than ½ inch from the zipper scoops. In the present invention, however, the tapes or webs 110 and 111 each are substantially wider, being in the preferred embodiment at least 2 inches wide. The exact width will be determined, of course, by the size and style of the garment, but for trousers I have found that a 2 inch tape is satisfactory, i.e., each section 110 and 111 has a total width of 2 inches. Preferably, also, the non-zipper edges 110*b*, 111*b*** are selvaged.

The left hand web 110, which connects with the left body panel, is folded and stitched under along line 112 thus to provide a single-ply portion 110c which is stitched to the edge of the left body panel 12 as at 113. The web 110 is then stitched as at 123 to the left hand body panel to to completely close the left hand fly. The right fly is constructed by folding the tape 111 to provide the extending portion 111c, which overlies the zipper scoops on the inside of the garment. The two-ply folded sections of the tape 111 are stitched as at 124 to the right body panel 13, and the fly is thus completed.

Obviously there has been a great reduction in the pieces of material as well as the number of stitches, with complete elimination of serge stitches.

If will be understood that if desired the fly closing stitches 123 can be single or two needle and that the fly attaching stitch 113 can penetrate to the surface of the body panel to show for "western" or other types of clothing where this is desired. Moreover, if deemed necessary a stitch can be added through the folded zipper tape in FIG. 4 to the left of stitch 112 to forestall or eliminate objection as to flagging.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. In a zipper fly construction for garments having a right and left panel to be joined by the fly, one of said panels being overlapped by the other at the fly, the combination of a first unitary piece of fabric secured to said one panel and forming a first web portion extending from said one panel, said first web portion having a free edge located beyond said one panel and zipper scoops secured along said free edge, said first piece of fabric also formed with a second web portion which is generally parallel with and overlies said first web portion, said second web portion overlying and terminating well past the zipper scoops, a second unitary piece of fabric secured to said other panel, said second piece forming a first web portion extending from said other panel, said first web portion on said second piece having a free edge and zipper scoops along said free edge for joinder with the zipper scoops on the first piece of fabric to close the fly, said second piece of fabric also formed with a second web portion which is generally parallel with and overlies said first web portion of said second piece and extends well past the zipper scoops on said second piece, said second piece connected to said other panel at spaced locations with the second web thereof secured to the portion of said other panel overlapping said first panel so that said overlapping portion of said other panel is on the opposite side of said second web portion, to which it is secured, from said zipper scoops, said pieces and panels so located relative to one another that the zipper scoop edges can be joined to connect the panels, and when joined, the joined zipper scoops are covered on one side by the second web portion of the first piece and on the other side by the second web portion of the second piece and the interconnected overlapping portion of the other panel.

2. The combination of claim 1, including connection means joining said first and second web portions of the second fabric piece together at a location offset from said spaced locations at which said second piece is connected to said other panel.

3. In a zipper fly construction for garments having a right and a left panel to be joined by the fly, the combination of a first zipper tape in the form of a fabric web having two parallel edges, one edge having zipper scoops secured therealong, said first tape having a longitudinal fold line to form a folded over portion of the web which terminates at the other edge with said portion overlying and extending well past the zipper scoops, means connecting said first tape near the fold line to one of said panels with said one edge spaced beyond said one panel, a second zipper tape in the form of a fabric web having two parallel edges, one edge having zipper scoops secured therealong, said second tape having a longitudinal fold line to form a folded over portion of the web of the second tape which terminates at the other edge of said second tape web with said folded portion overlying and extending well past the zipper scoops on the second tape, means connecting said second tape to the other panel at spaced apart locations so that a marginal portion of said other panel overlies and is secured to said folded over portion of the web on the second tape, on the opposite side of said web portion from the zipper scoops, said panels and tapes so located relative to one another that the zippered edges can be joined to connect the panels and when joined, the zipper is covered on one side by the folded over portion of the first tape, and on it the other side by the connected folded over portion of the second tape and other panel.

4. The combination of claim 3, including connection means securing said second zipper tape in folded over form at a location offset from said spaced apart locations at which said second tape is connected to said other panel.

* * * * *